United States Patent [19]

Corlett et al.

[11] Patent Number: 4,838,191

[45] Date of Patent: Jun. 13, 1989

[54] LOW-DRAG SAILBOAT MAST

[76] Inventors: Edwin H. Corlett; Edwin H. Corlett, Jr., both of c/o Corlett & Associates, 110 W. Madison St., Oak Park, Ill. 60302

[21] Appl. No.: 210,826

[22] Filed: Jun. 24, 1988

Related U.S. Application Data

[63] Continuation-in-part of Ser. No. 67,547, Jun. 29, 1987, abandoned.

[51] Int. Cl.[4] ..... B63B 35/00

[52] U.S. Cl. ..... 114/90; 114/105

[58] Field of Search ..... 114/89, 90, 92, 104, 114/105, 108, 112, 113

[56] References Cited

U.S. PATENT DOCUMENTS

| | | | |
|---|---|---|---|
| 420,023 | 1/1890 | Stifel | 114/90 |
| 601,494 | 3/1898 | Clapham | 114/90 |
| 774,371 | 11/1904 | Altmyer . | |
| 792,924 | 6/1905 | Posgate | 114/90 |
| 879,986 | 2/1908 | Tatchell | 114/89 |
| 1,213,579 | 1/1917 | Bonom . | |
| 3,085,539 | 4/1963 | Prolss | 114/89 |
| 3,447,276 | 6/1969 | Svensson et al. | 52/648 |
| 4,474,127 | 10/1984 | Stevenson | 114/105 |
| 4,546,718 | 10/1985 | Schwarz | 114/89 |
| 4,633,624 | 1/1987 | Targetti | 52/28 |

*Primary Examiner*—Sherman D. Basinger
*Assistant Examiner*—Stephen P. Avila
*Attorney, Agent, or Firm*—Wood, Dalton, Phillips, Mason & Rowe

[57] ABSTRACT

A mast for a sailboat includes a plurality of spaced parallel bars arranged as a polygon in cross-section wherein the bars are of a size to permit air flow therebetween and being oriented such that one of the bars is disposed nearer the aft of the boat than the remaining bars. Bracing members are secured between the bars and means are provided for securing a luff edge of a sail to the one bar to thereby attach the sail to the sailboat.

12 Claims, 2 Drawing Sheets

FIG. 1
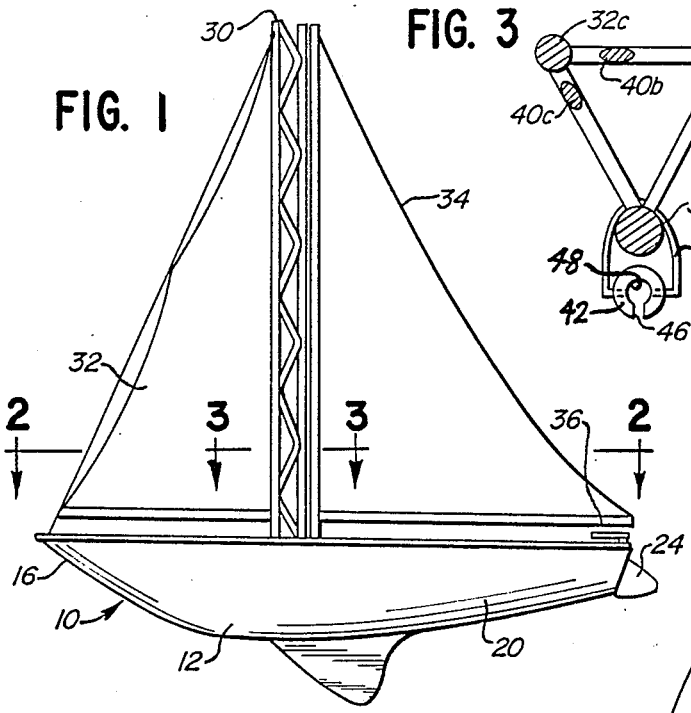
FIG. 3
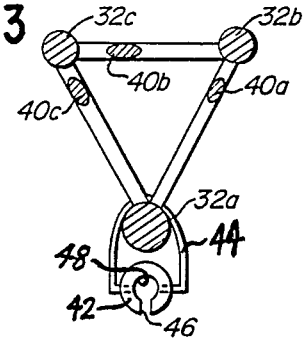
FIG. 2
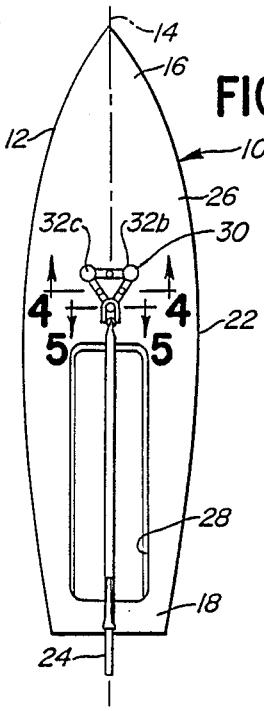
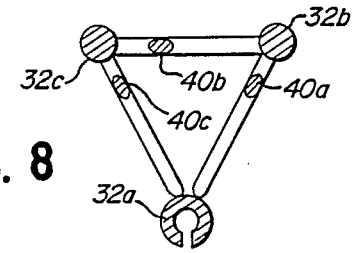
FIG. 8
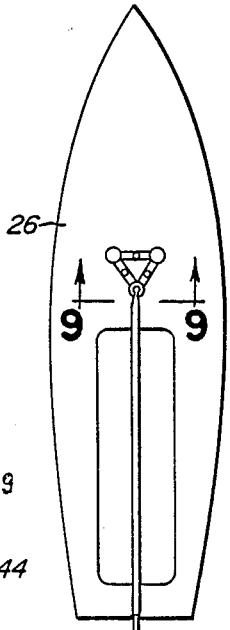
FIG. 7
FIG. 4
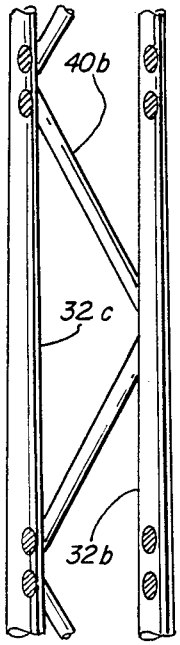
FIG. 5
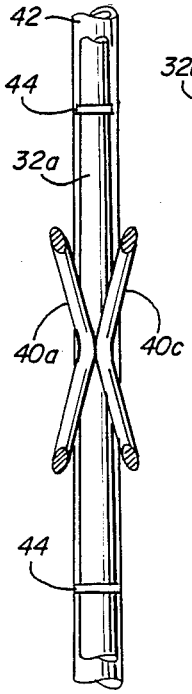
FIG. 6
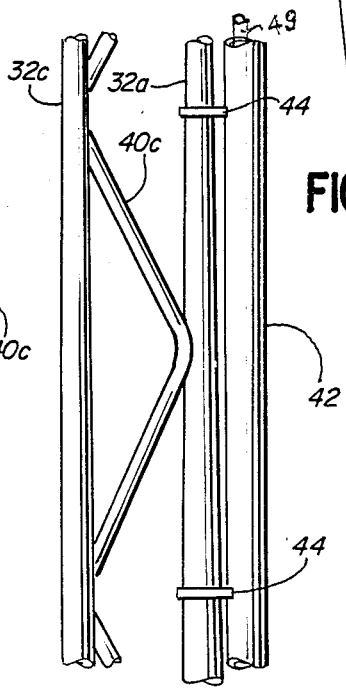
FIG. 9
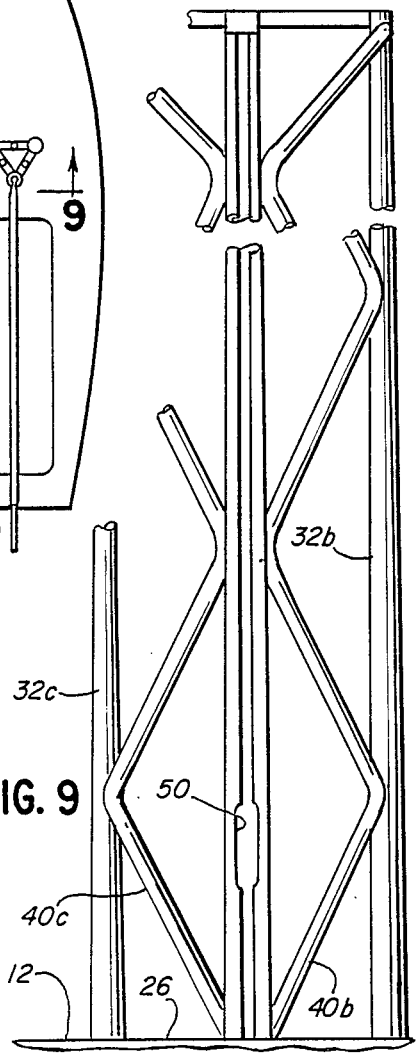

LOW-DRAG SAILBOAT MAST

CROSS REFERENCE TO RELATED APPLICATION

This application is a continuation-in-part of Corlett et al. U.S. application Ser. No. 067,547, filed June 29, 1987, entitled "Low-Drag Sailboat Mast" now abandoned.

1. Technical Field

The present invention relates generally to sailboat masts, and more particularly to a mast for a sailboat which exhibits low drag.

2. Background Art

It has been recognized that the efficiency of a sailboat mast is improved by making the mast aerodynamically shaped, light in weight and small in cross-section. Typically, the first criteria has been met by providing the mast with a pear-shaped or wing-shaped cross-section. Such shapes are aerodynamically efficient when the mast is directly headed into the wind, but are less efficient when the angle of wind incidence is different. In fact, such masts can act as stalled airfoils in the latter case, thereby creating significant leeward turbulence on the mast and attached sail which increases drag and detracts from the driving power of the sail.

The desired small mast weight has been approached by using new or composite materials which can provide a favorable stiffness-to-weight ratio. However, such masts may have an undesirably large cross-sectional size for the required stiffness or can be made small in which case additional support would be required. Hence, these must have not been entirely satisfactory. Also, these materials are expensive and hence have not been approved for use in competition. Similarly, the desired small cross-sectional size can be achieved by using stiff materials; however, such materials are unduly heavy and are thus unsuitable for this purpose.

Multiple-component masts utilizing a plurality of main support members interconnected by braces are disclosed in Schwartz U.S. Pat. No. 4,546,718 and Prolss U.S. Pat. No. 3,085,539. Both masts include three main support members which converge toward each other and are joined at the top. The masts are particularly designed for square-rigged sails which are secured to the front or bow end of the mast. Each mast is arranged on the sailboat such that an apex of the triangle formed by the three support members is disposed toward the bow of the boat while the side opposite such apex is disposed toward the stern of the boat. In addition, the bracing members extend at right angles to the longitudinal axis of the mast.

Still further sailboat masts having multiple main support members interconnected by braces include Bonom U.S. Pat. No. 1,213,579 and Posgate U.S. Pat. No. 792,924. These masts, however, are apparently not triangular in cross-section and each main support member is relatively large in cross-section.

Other support structures having multiple members arranged in polygonal cross-sectional shapes are disclosed in Targetti U.S. Pat. No. 4,633,624, Altmyer U.S. Pat. No. 774,371 and Svensson et al U.S. Pat. No. 3,447,276. These support structures, however, are not adapted to support a sail and thus are not concerned with the unique problems faced by sailboat masts.

Applicants are aware of a tapered mast for a sailboat having three hollow tubes, each of constant cross-sectional shape, arranged as a triangle in cross-section wherein one of the tubes is disposed nearer the stern of the sailboat than the other two bars. The one tube is round in cross-section whereas the remaining two tubes are shaped as an airfoil in cross-section. The tubes are interconnected by horizontal bracing members. A sail is attached to the one tube closest to the stern. The tubes are not parallel over the length of the mast; rather, the tubes converge toward the top of the mast.

As is well-known, a mast need not be as stiff toward the top thereof than at the bottom. Knowledge of this design consideration can lead to an advantageous reduction in the weight of the mast for a required stiffness. As an example, with some present day aluminum masts, a wedge is cut out of the mast shell in the upper part of the mast. The resulting opening is then forced closed and welded, causing a reduction in stiffness in the upper part of the mast and a lessening of overall mast weight. In the tapered mast described in the immediately preceding paragraph, the tubes converge toward the top of the mast, thus leading to a reduction in stiffness, but not a significant reduction in the amount of material needed to fabricate the mast when compared with a mast in which the bars are parallel over the entire length thereof. Thus, this tapered mast does not take advantage of the above-noted design consideration to reduce mast weight.

SUMMARY OF THE INVENTION

In accordance with the present invention, a spar, such as a mast for securing a sail to a sailboat exhibits little drag and is light in weight.

More specifically, the mast includes a plurality of spaced main members or bars arranged as a polygon in cross-section wherein the bars are of a size to permit air to readily flow therebetween so that drag is greatly reduced. The bars are oriented such that one of the bars is disposed nearer the aft of the boat than the remaining bars. Bracing members are secured between the bars to provide necessary stiffness. Means are provided for securing a luff edge of a sail to the one bar so that the sail is disposed generally between the mast and the aft end of the boat.

In the preferred embodiment, there are three spaced parallel bars arranged as a triangle in cross-section such that a side of the triangle opposite the one bar is disposed toward the bow of the sailboat. The bars are solid and are of decreasing diameter toward the top of the mast so that a highly favorable weight reduction is obtained for a required mast stiffness. In fact, the mast of the present invention is believed to be lighter than the tapered mast described in the "background art" section above.

Alternatively, the bars may be hollow and have decreasing wall thickness toward the top of the mast, thereby leading to the desirable reduction in weight.

Further, the securing means may comprise a hollow luff tube joined by bales to the one bar. A longitudinal slit extends along the luff tube so that the luff edge of the sail may be placed and retained within the luff tube. Alternatively, the luff tube may be dispensed with, in which case the luff edge of the sail may be secured to the mast by other means. In any case, the luff edge of the sail is disposed in the air flow wake created by the one bar, thus further reducing drag and increasing driving power.

In accordance with a further aspect of the invention, the bars and/or bracing members are round in cross-section so that drag and overall mast weight are kept to a minimum regardless of the direction of the wind relative to the mast.

BRIEF DESCRIPTION OF THE DRAWINGS

FIG. 1 is an elevational view of a sailboat together with a mast according to the present invention;

FIG. 2 is a sectional view taken along the lines 2—2 of FIG. 1;

FIG. 3 is a sectional view taken along the lines 3—3 of FIG. 1;

FIG. 4 is a sectional view taken along lines 4—4 of FIG. 2;

FIG. 5 is a sectional view taken along lines 5—5 of FIG. 2;

FIG. 6 is an enlarged elevational view of a portion of the mast shown in FIG. 1;

FIG. 7 is a view similar to FIG. 2 illustrating an alternative embodiment of the invention;

FIG. 8 is a view similar to FIG. 3 showing the embodiment of FIG. 7;

FIG. 9 is an elevational view taken generally along the lines 9—9 of FIG. 7.

DESCRIPTION OF THE PREFERRED EMBODIMENT

Figure 10:
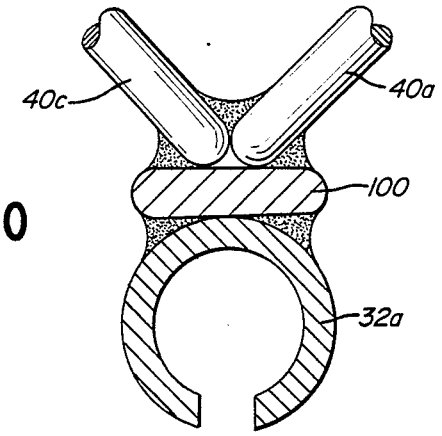
FIGS. 10–14 are enlarged fragmentary sectional views similar to FIG. 3 illustrating further alternative embodiments of the invention.

Referring now to FIGS. 1–6, a sailboat 10 includes a hull 12 having a centerline 14 which extends between a bow 16 and a stern 18 substantially midway between port and starboard sides 20,22. A rudder 24 is provided at the stern 18 to enable maneuvering of the boat 10.

A deck 26 is disposed atop the hull 12. An opening 28 is provided in the deck 26 to accommodate an occupant.

It should be noted that the particular sailboat illustrated in the figures is exemplary only, it being understood that a different type of sailboat may alternatively be used, if desired.

A mast 30 according to the present invention is secured to the deck 26 and/or the hull 12. The mast supports at least one and preferably two sails comprising a jib 32 and a mainsail 34. A boom 36 may also be secured to the mast 30 to provide support for the sail 34, as is conventional.

As seen specifically in FIGS. 2 and 3, the mast 30 comprises a plurality of spaced parallel main members or bars arranged as a polygon in cross-section. In the preferred embodiment, the bars are three in number **32*a*,32*b*,32*c* arranged in a triangular configuration. The bars 32*a*–32*c* are of small cross-sectional size and are spaced to permit ready air flow therebetween. The bars 32 are oriented such that one of the bars, for example the bar 32*a*, is disposed nearer the aft end or stern 18 of the boat 10 than the remaining bars 32*b*, 32*c***.

In the preferred embodiment, all of the main bars are round in cross-section so that the drag imposed by the mast is maintained at a small, substantially constant level irrespective of differences in wind angle incident upon the mast 30. The main bars may alternatively be of a different cross-sectional shape, if desired.

Also in the preferred embodiment, the aft-most bar **32*a* is positioned substantially coincident with the centerline 14. Also, a line connecting the bars 32*b*,32*c* is substantially perpendicular to the longitudinal axis 14**.

As seen in FIG. 1, the bars **32*a*–32*c* are substantially parallel over the entire length thereof and are substantially vertical when the sailboat in on an even keel and at zero pitch. Preferably, the bars 32*a*–32*c* are solid and are tapered so that they are thinner at the top than at the bottom. Alternatively, the bars may be hollow and the wall thicknesses of the hollow bars may be reduced towards the top of the mast 30. Both designs take advantage of the fact that the mast 30 need not be as strong at the top, thereby leading to a highly favorable weight reduction. Also, the main bars 32*a*–32*c*** need not be parallel and in fact may converge at the top thereof.

Typically, although not necessarily, at the same point along the length of the mast 30, the bars **32*b*, 32*c* have the same diameter while the rear bar 32*a* diameter may be the same as or different than the diameter of the bars 32*b*, 32*c***.

Secured between each main bar **32*a*–32*c* and the other bars are a series of bracing members or bars which extend diagonally along the length of the mast 30. The bracing members 40*a*–40*c* are preferably also round in cross-section, constant in diameter along the length of the mast and solid throughout. The members 40 may instead be hollow, have varying or different diameters along the length of the mast or may have a different cross-sectional shape, if desired. The bracing members 40*a*–40*c* provide rigidity for the mast 30, yet present very little obstruction to wind passing between the bars 32*a*–32*c*** so that drag is reduced for all sailing angles.

As seen specifically in FIGS. 4–6, the bracing members **40*a*–40*c* are welded or otherwise joined to the bars 32*a*–32*c* at spaced points along the length thereof. In addition, as seen specifically in FIG. 5, the bracing members, for example the members 40*a*,40*c*, are joined to the bar 32*a* at points laterally adjacent one another. The points at which the bracing members are joined to the bars may alternatively be longitudinally spaced along the main bars 32*a*–32*c***, if desired.

Means are provided for securing a luff edge of a sail to the aft-most bar **32*a*. In the preferred embodiment, such means comprises a luff tube 42 which is secured by bales 44 to the main bar 32*a*. The luff tube has a longitudinal slot 46 extending along the length thereof and a channel 48 within the tube. The channel 48 may receive a bolt rope 49 disposed within the luff edge of a sail so that the sail is secured to the mast 30. The luff tube 46 is preferably, although not necessarily made of plastic and may include a widened opening near the bottom thereof to permit entry of the luff edge into the channel, or the widened opening may be omitted and the sail luff edge can be inserted from the bottom and pulled up the luff tube 42**.

The bolt rope diameter is substantially greater than the width of the longitudinal slot 46 in the luff tube but is less than the diameter of the channel 48. The sail is thus firmly secured to the luff tube 42 which is in turn secured by the bales 44 to the main bar **32*a***.

As seen in FIGS. 7–9, the securing means may alternatively comprise the main bar **32*a* itself, in which case a longitudinal slot and a channel are formed in the bar 32*a* to receive the sail luff edge bolt rope 49. A widened slot portion 50 may be provided at or near the bottom of the main bar 32*a*** to facilitate insertion of the bolt rope, if desired.

Illustrated in FIGS. 10–14 are alternative embodiments of the invention. FIG. 10 illustrates an embodiment which is identical to that shown in FIGS. 7–9 with the exception that a support bar 100 fabricated of stainless steel or other material is welded between the bracing members **40*c*, 40*a* and the main bar 32*a***. The support bar lends added stiffness to the mast, if necessary or desirable.

Figure 11:
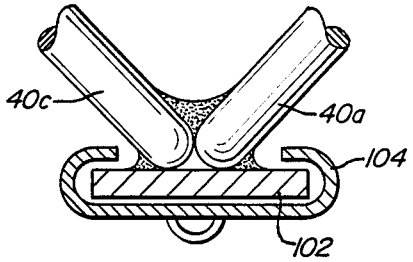
Figure 13:
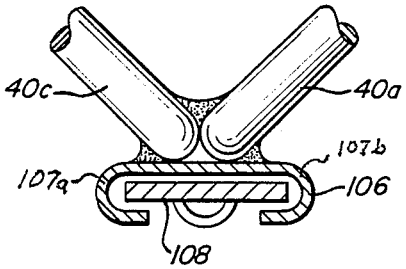

FIGS. 11 and 13 illustrate a different securing means for securing the luff edge of the sail to the mast 30. In the case of FIG. 11, the aft-most bar 32*a* is replaced by a generally rectangular main bar 102 which is welded to the bracing members 40*a*, 40*c*. One or more cup-shaped sail slides 104 which are secured to a luff edge of the sail partially surround the main bar 102 such that the sail is fixed to the mast yet the slides can move longitudinally along the mast 30. In this way, the sail can be hoisted on or removed from the mast.

The embodiment of FIG. 13 includes a main bar 106 which includes flanges 107*a*, 107*b* so that the bar is cup-shaped in cross section and which is adapted to receive one or more internal sail slides 108 that are fastened to the luff edge of the sail. The main bar 106, again, may be welded or otherwise fastened to the bracing members 40*a*, 40*c*. Similar to the embodiment shown in FIG. 11, the sail slides are movable longitudinally along the mast to allow hoisting or removal of a sail.

Figure 12:
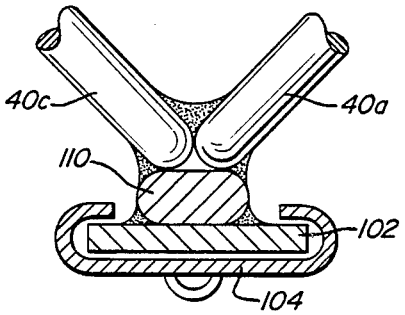
Figure 14:
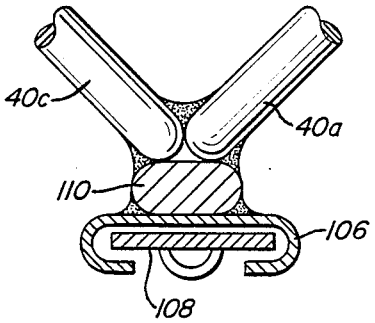

FIGS. 12 and 14 illustrate embodiments identical to those in FIGS. 11 and 13, respectively, except that a support bar 110 similar to the support bar 100 shown in FIG. 10 is welded or otherwise secured between the bracing members 40*a*, 40*c* and the main bars 102 or 106.

Referring again to FIGS. 2 and 3, it can be seen that the luff tube 42 is allowed to pivot around the main bar 32*a* so that the luff tube 42 is in the air flow wake thereof. This reduces adverse air flow disturbances and thus increases the driving power of the sail.

It can be seen that this advantage is also realized by the other embodiments of FIGS. 7–14. In fact, drag may be somewhat reduced in these embodiments as compared with the first embodiment due to the elimination of the luff tube 42.

The openness of the mast 30 reduces air drag by a significant amount as compared with conventional "aerodynamically" shaped masts. Further, the bars 32, 100, 102, 106, 110 and bracing members 40 may be fabricated of stainless steel, extruded aluminum or a lightweight material such as graphite which reduces the overall weight of the mast 30. In addition, the desired stiffness is obtained through the use of the bracing members 42 without an undesirable increase in cross-sectional size. Thus, the required stiffness is achieved without a corresponding increase in drag.

It should be noted that the bars 32, 40, 100, 102, 106 and/or 110 may have a dimpled or rough surface to provide added effects.

The tapering of the solid bars 32*a*–32*c* (or decrease in wall thickness of the bars 32*a*–32*c*, if hollow) toward the top of the mast 30 is believed to take better advantage of the fact that the mast 30 need not be as strong at the top as at the bottom, when compared with prior designs, including the tapered mast described hereinabove. Thus, mast weight is reduced for a given required stiffness and weight and hence driving efficiency is increased.

The mast 30 according to the present invention provides other advantages not realized by conventional masts. Halyards and other rigging may be easily strung within the mast and a condition of same can be easily observed in use. Further, upon capsizing the mast cannot fill with water and hence recovery time is lessened. The mast may also be modified easily without undue cost and easily tied to, welded to, clamped to or otherwise fastened to, as desired.

The present invention is not limited to use as a mast for a sailboat inasmuch as it may be used as any spar or other sail control device, such as a boom, and may be used on sail or wind boards, ice boats or any other sail-driven vehicle.

We claim:

1. A sail control device for a sail-driven vehicle having a stern, comprising:

a plurality of spaced parallel bars arranged as a polygon in cross-section, the bars being of a size to permit air flow therebetween and being oriented such that one of the bars is disposed nearer the stern of the sail-driven vehicle than the remaining bars wherein the bars are of one of two types: (a) solid and of decreasing diameter toward a top of the sail control device, and (b) hollow and having wall thickness which decrease toward the top of the sail control device;

bracing members secured between the bars; and means for securing a luff edge of a sail to the one bar.

2. The sail control device of claim 1, wherein the securing means comprises a luff tube having a longitudinal slot and a channel therein for receiving and holding the luff edge of the sail.

3. The sail control device of claim 1, wherein the securing means comprises a longitudinal slot and a channel in the one bar for receiving and holding the luff edge of the sail.

4. The sail control device of claim 1, wherein the bars are round in cross-section.

5. The sail control device of claim 1, wherein there are three spaced parallel bars arranged in a triangle in cross-section wherein a side of the triangle opposite the one bar is disposed toward the bow of the boat.

6. The sail control device of claim 5, wherein the bracing members extend diagonally along the mast between each bar and the other two bars.

7. The sail control device of claim 1, wherein the securing means includes at least one sail slide secured to the luff edge of the sail and slidable longitudinally on the one bar.

8. The sail control device of claim 7, wherein the one bar is cup-shaped in cross-section and the sail slide is retained within the one bar.

9. The sail control device of claim 7, wherein the sail slide is cup-shaped in cross-section and the one bar is rectangular in cross-section and is disposed within the sail slide.

10. The sail control device of claim 1, wherein the means for securing a luff edge of the sail to the one bar includes a luff tube having a longitudinal slot and channel therein for receiving and holding the luff edge of the sail, the luff tube being swingably connected longitudinally of the one bar to move freely side-to-side transversely of the one bar.

11. The sail control device of claim 1, wherein the spaced bars define an elongate central chamber extending longitudinally of the bars, the chamber accommodating halyards and other rigging for ease of stringing and for ease of observance while being used.

12. A mast for securing a sail to a sailboat having a bow, a stern and a centerline extending between the bow and stern, comprising:

three parallel main bars defining a triangle in cross-section, one of the main bars being positioned substantially on the centerline and nearer the stern than the other main bars such that a side of the triangle opposite the one main bar faces the bow and is substantially perpendicular to the centerline, each main bar being round, solid throughout and of decreasing diameter toward a top of the mast;

diagonally arranged bracing bars extending between and secured to the main bars, each bracing bar being round; and means for securing a luff edge of the sail to the one main bar, said securing means including a luff tube secured by bales to the one main bar such that the luff tube is generally disposed nearer the stern than the one bar, the luff tube being hollow and having a longitudinal slit such that the luff edge of a sail may be retained within the luff tube to secure the sail to the sailboat.

* * * * *